US008631770B2

(12) United States Patent
Besmann

(10) Patent No.: US 8,631,770 B2
(45) Date of Patent: Jan. 21, 2014

(54) MITIGATING THE EFFECT OF SILOXANES ON INTERNAL COMBUSTION ENGINES USING LANDFILL GASSES

(75) Inventor: Theodore M. Besmann, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 247 days.

(21) Appl. No.: 13/021,375

(22) Filed: Feb. 4, 2011

(65) Prior Publication Data

US 2012/0199083 A1 Aug. 9, 2012

(51) Int. Cl.
*F02B 43/00* (2006.01)

(52) U.S. Cl.
USPC ..... 123/1 A; 123/1 R; 95/8; 95/11; 95/141; 508/186

(58) Field of Classification Search
USPC ..... 123/1 A, 1 R, 3; 95/8, 11, 141, 147, 148; 508/186, 272, 280; 431/5
See application file for complete search history.

(56) References Cited

U.S. PATENT DOCUMENTS

| | | | | |
|---|---|---|---|---|
| 5,034,020 | A * | 7/1991 | Epperly et al. | 44/358 |
| 5,059,405 | A * | 10/1991 | Watson et al. | 423/210 |
| 5,453,210 | A * | 9/1995 | Bardasz et al. | 508/186 |
| 5,692,458 | A * | 12/1997 | Green | 123/2 |
| 6,365,108 | B1 * | 4/2002 | Philyaw | 422/98 |
| 7,025,803 | B2 * | 4/2006 | Wascheck et al. | 95/50 |
| 7,264,648 | B1 * | 9/2007 | Wetzel et al. | 95/8 |
| 2006/0000352 | A1 * | 1/2006 | Tower et al. | 95/8 |
| 2008/0311640 | A1 * | 12/2008 | Cox et al. | 435/168 |

OTHER PUBLICATIONS

Paul Tower, "New Technology for Removal of Siloxanes in Digester Gas Results in Lower Maintenance Costs and Air Quality Benefits in Power Generation Equipment" WEFTEC, 78th Annual Technical Exhibition and Conference, Oct. 11-15, 2003.

P.M. Tower and J.V. Wetzel, "Making Power Generation Make Sense by Removing Siloxanes from Digester Gas" Applied Filter Technology, Inc., Snohomish, WA,USA, Presented at CWEA Conference, Apr. 4-7, 2006.

Ed Wheless and Jeffrey Pierce, "Siloxanes in Landfill and Digester Gas Update" Presented at SWANA 28th Landfill Gas Symposium, San Diego, California, Mar. 2005.

Martin Schweigkofler and Reinhard Niessner, "Removal of Siloaxens in Biogases", ELSEVIER, Journal of Hazardous Materials, 2001, pp. 183-196.

(Continued)

*Primary Examiner* — Noah Kamen
*Assistant Examiner* — Long T Tran
(74) *Attorney, Agent, or Firm* — Scully, Scott, Murphy & Presser, P.C.

(57) ABSTRACT

A waste gas combustion method that includes providing a combustible fuel source, in which the combustible fuel source is composed of at least methane and siloxane gas. A sodium source or magnesium source is mixed with the combustible fuel source. Combustion of the siloxane gas of the combustible fuel source produces a silicon containing product. The sodium source or magnesium source reacts with the silicon containing product to provide a sodium containing glass or sodium containing silicate, or a magnesium containing silicate. By producing the sodium containing glass or sodium containing silicate, or the magnesium containing silicate, or magnesium source for precipitating particulate silica instead of hard coating, the method may reduce or eliminate the formation of silica deposits within the combustion chamber and the exhaust components of the internal combustion engine.

12 Claims, 3 Drawing Sheets

(56) References Cited

OTHER PUBLICATIONS

PPTek: "Advancing Purification Technology", Home Page. 2011, accessed Nov. 24, 2010; http://www.pptek.co.uk/siloxane_cause.php.

Michiel Doorn et al., "Landfill Gas Energy Utilization Experience: Discussion of Technical and Non-Technical Issues, Solutions and Trends", prepared for U.S. Environmental Protection Agency, EPA-600/R-95-035, Mar. 1995; and.

* cited by examiner

MITIGATING THE EFFECT OF SILOXANES ON INTERNAL COMBUSTION ENGINES USING LANDFILL GASSES

STATEMENT REGARDING FEDERALLY SPONSORED RESEARCH OR DEVELOPMENT

This invention was made with Government support under Contract No. DE-AC05-00OR22725 awarded by the United States Department of Energy. The government has certain rights in this invention.

BACKGROUND

The present disclosure is related to power generation from waste gasses, such as landfill gasses.

Electricity generated from landfill waste gas reduces the demand for electricity from fossil fuels. In addition, combusting the landfill gas, which is largely comprised of the "greenhouse" gas, i.e., methane, prevents the methane from escaping into the atmosphere where it is more damaging to the atmosphere's ozone layer than carbon dioxide. Fuel sources that are generated from landfill waste gasses pose a unique set of challenges for the operation of internal combustion engines of electrical power generators. The quality and quantity of waste gas being generated by the landfill fluctuates by time of day, time of year and the amount of precipitation. Further, the internal combustion engines of the generator may be required to run continuously for days requiring that the generators be extremely durable. The durability of the internal combustion engines may be reduced by the formation of deposits on the combustion and exhaust surfaces of the internal combustion engine formed from the combustion of the landfill waste gasses.

SUMMARY

A method is provided that reduces silica deposit formation from siloxanes within internal combustion engines that are fueled by waste gasses including methane, such as in landfill gasses and sewer gasses. In one embodiment, a waste gas combustion method is provided that includes providing a combustible fuel source, in which the combustible fuel source is composed of at least methane and siloxane gas. A sodium source is mixed with the combustible fuel source. The combustible fuel source and the sodium source is ignited in the combustion chamber of an internal combustion engine. Combustion of the siloxane gas of the combustible fuel source produces a silicon containing product. The sodium source reacts with the silicon containing product to provide a sodium containing glass or sodium containing silicate.

The formation of silica deposits may also be reduced or substantially eliminated by a magnesium source that is mixed with the combustible fuel source. In one embodiment, the waste gas combustion method may include providing a combustible fuel source comprising at least methane and siloxane gas. The magnesium source is mixed with the combustible fuel source. The combustible fuel source including the magnesium source is then ignited within an internal combustion engine. Combustion of the siloxane gas of the combustible fuel source produces a silicon containing product. The magnesium source reacts with the silicon containing product to provide a magnesium containing silicate.

BRIEF DESCRIPTION OF THE DRAWINGS

The following detailed description, given by way of example and not intended to limit the disclosure solely thereto, will best be appreciated in conjunction with the accompanying drawings, wherein like reference numerals denote like elements and parts, in which.

DETAILED DESCRIPTION

Figure 1:
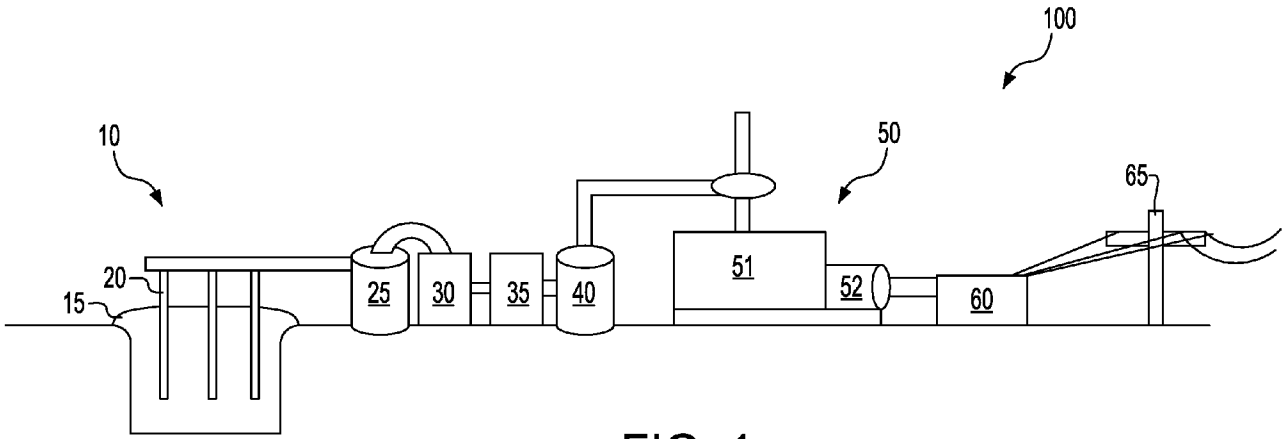
FIG. 1 is a schematic depicting one embodiment of generating electricity from landfill waste gasses, in accordance with the present disclosure.

Detailed embodiments of the claimed structures and methods are disclosed herein; however, it is to be understood that the disclosed embodiments are merely illustrative of the claimed structures and methods that may be embodied in various forms. In addition, each of the examples given in connection with the various embodiments are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the methods and structures of the present disclosure.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The present disclosure relates to the reduction or modification of the formation of silica deposits from the combustion of waste gasses, e.g., methane ($CH_4$) gasses, containing siloxanes. Waste gasses are one source of fuel for power generation, such as gas energy applications, which include electricity generation via reciprocating internal combustion engines, turbine engines, and steam engines. The waste gasses may also provide a substitute for natural gas in transportation applications employing internal combustion engines. It is noted that the present disclosure is suitable for any application in which waste gasses are being combusted to provide an energy source. In each of these applications, combustion of the waste gas includes combustion of siloxane containing gas. Combustion of the siloxane gas typically results in silica deposits ($SiO_2$). The term "silica deposit" as used to describe a deposit formed from the combustion of siloxane gas means a glass composition that is greater than 95% silicon dioxide ($SiO_2$). In one aspect, the present disclosure reduces the formation of the silica deposits ($SiO_2$) formed by the combustion siloxane gas reacting the products of siloxane combustion with a sodium (Na) source, magnesium (Mg) source or a combination thereof. In some embodiments, by "reduce the formation of silica deposits ($SiO_2$)" it is meant that the silica deposits ($SiO_2$) are modified into silicates that have a hardness that is less than the hardness of silica ($SiO_2$). The silicates formed by modifying silica ($SiO_2$) in accordance with the present disclosure may also be more water-soluble than silica ($SiO_2$).

Waste gasses, such as those produced by landfills, are a suitable source for electrical power generation. FIG. 1 depicts a power generation system 100 including a reciprocating internal combustion engine 50 powered by landfill waste gas. "Waste gasses", as used herein, denote a gas composition that includes at least methane ($CH_4$). Microbial decomposition of refuse buried in landfills 15 generates waste gas principally composed of 55% to 60% methane ($CH_4$) and 40% to 45% carbon dioxide ($CO_2$). The waste gasses produced by the landfill 15 will also include a siloxane containing gas component. The waste gasses may also include at least one of $H_2S$, $H_2O$, $N_2$, and CO.

Siloxanes are a family of organic compounds that contain silicon, oxygen and methyl groups. As used herein, the term "siloxanes" denotes any chemical compound composed of units of the form $R_2SiO$, wherein R is a hydrogen or hydrocarbon group. Some examples of siloxane gasses that may be produced by the landfill 15 include, but are not limited to: hexamethylcyclotrisiloxane ($C_{12}H_{18}O_3Si_3$) (also referred to as "D3"), octamethylcyclotetrasiloxane ($C_8H_{24}O_4Si_4$) (also referred to as "D4"), decamethylcyclopentasiloxane ($C_{10}H_{30}O_5Si_5$) (also referred to as "D5"), dodecamethylcyclohexasiloxane ($C_{12}H_{36}O_6Si_6$) (Also referred to as "D6"), hexamethylsiloxane ($C_6H_{18}OSi_2$) (also referred to as "L2"), hexamethyldisiloxane ($C_6H_{18}Si_2O$) (also referred to as "MM"), octomethyltrisiloxane ($C_8H_{24}Si_3O_2$) (also referred to as "MDM"), decamethyltetrasiloxane ($C_{10}H_{30}Si_4O_3$), dodecamethylpentasiloxane ($C_{12}H_{36}Si_5O_4$), and combinations thereof.

The composition of the siloxane gas may be linear (not shown) or the composition of the siloxane gas may be branched or cyclical, as depicted below.

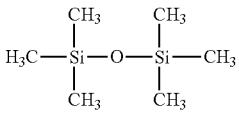

Siloxane "MM"

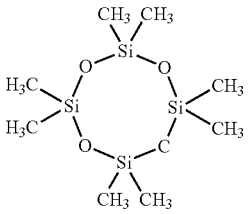

Siloxane "D4"

The siloxane gas component of the waste gas produced by the landfill 15 may be produced by consumer products that have been disposed of within the landfill 15. Examples of siloxane containing consumer products include personal care products, such as deodorants, tooth-pastes, skin care preparations, hair conditioners and as carriers in anti-perspirants. The aforementioned lists of siloxane compositions and siloxane gas sources is provided for illustrative purposes only, as any composition of siloxane gas and any source of siloxane gas may contribute to the siloxane gas component of the waste gas that is produced by the landfill 15.

As organic matter within the landfill 15 decomposes it produces methane ($CH_4$) and carbon dioxide ($CO_2$). The siloxane gas blends with the methane ($CH_4$) and carbon dioxide ($CO_2$) produced by the organic matter that is decomposing within the landfill 15, therefore contaminating the waste gas that is being produced by the landfill 15. It is noted that the siloxane containing gas component of the waste gas may vary depending upon the composition of the waste being decomposed in the landfill 15, as well as the air temperature and moisture content of the landfill 15. In one embodiment, the siloxane containing gas component of the waste gas may range from 2 $mg/m^3$ to 140 $mg/m^3$. In another embodiment, the siloxane containing gas component of the waste gas may range from 8 $mg/m^3$ to 20 $mg/m^3$.

Referring to FIG. 1, extraction systems 10 for recovering waste gas from landfills 15 typically include vertical wells 20 in combination with horizontal trenches (not shown) that are formed into the landfill 15, through which the waste gas is extracted from the landfill 15 by the application of a vacuum. In some embodiments, the vertical wells 20 and the horizontal trenches are composed of a permeable membrane. Following extraction of the waste gasses from the landfill 15, the waste gas is processed and compressed to provide a combustible fuel source that is suitable for use in internal combustion engines 51.

In one example, processing of the waste gas may include transporting the waste gas to a first fluid separator/filter 25 to remove solids and debris from the waste gas. Once the waste gas has been filtered, it may than be pressurized in a compressor 30. Typically, as the waste gas is compressed, heat is generated, which may need to be expelled via heat exchanger/refrigeration units 35. In some instances, as the compressed waste gas is cooled condensation is formed. The condensation may be removed from the compressed and cooled waste gas by a second fluid separator/filter 40. Following filtering and compression of the waste gas that is extracted from the landfill 15, the waste gas may serve as a combustible fuel source.

Referring to FIG. 1, the compressed and cooled waste gas, i.e., combustible fuel source, may then enter the power generator 50. The power generator 50 typically includes an internal combustion engine 51 and an electric generator 52. The internal combustion engine 51 is an engine in which the combustion of a fuel, i.e., combustible fuel source provided by the landfill waste gas, occurs with an oxidizer (usually air) in a combustion chamber. In an internal combustion engine the expansion of the high-temperature and high-pressure gases produced by combustion applies direct force to some component of the engine, such as pistons. This force moves the component over a distance, generating mechanical energy. Although, the internal combustion engine 51 is described above as a reciprocating engine, also known as a piston engine, is which one or more reciprocating pistons convert pressure into a rotating motion, the present disclosure is not limited to only this embodiment, as the internal combustion engine 51 may also be a turbine based engine. In turbine based engines, the high-temperature and high-pressure gases produced by combustion applies direct force to the turbine blades or nozzles of the engine, in which this force moves the turbine blades or nozzles over a distance, generating mechanical energy. The internal combustion engine 51 of the power generator 51 is in mechanical connection with the electric generator 52, in which the electric generator 52 converts the rotational mechanical motion of the internal combustion engine 51 into electricity. In one embodiment, the electric generator 52 converts mechanical energy into electrical energy through an electromagnetic induction process. The electrical energy produced by the electric generator 52 is then transferred to a step up converter 60 that increases the voltage to the line voltage 65.

The combustible fuel source produced from the landfill waste gas that is being burned in the internal combustion engine 51 includes the siloxane gas portion. Referring to FIG. 2, in some embodiments, the combustible fuel source is mixed in a carburetor 45 with air from an air intake 55 prior to entering the combustion chamber of the internal combustion engine 51. In one embodiment, the carburetor 45 may be a device that blends air and fuel for combustion in an internal combustion engine 51. The combustible fuel source within the internal combustion engine 51 is basically the reaction of the combustible fuel source with the oxygen (O2) in the air from the air intake 55. The amount of oxygen present in the combustion chamber is the limiting factor for the amount of the combustible fuel source the can be burnt. In one embodiment, in which the methane ($CH_4$) is the fuel component of the combustible fuel source produced from the landfill waste gas, the flow of the combustible fuel source and the flow of the air from the air intake is selected to provide a stoichiometric air-fuel ratio of approximately 17:2.

Typically, the siloxane gas portion of the combustible fuel source is converted into silicon dioxide ($SiO_2$) as combustion takes place within the internal combustion engine 51. In one aspect of the present disclosure, an additive is introduced to the internal combustion engine 51 to react with the silicon dioxide ($SiO_2$) that is being produced by the combustion of the siloxane gas portion of the combustible fuel source. When unimpeded, the silicon dioxide ($SiO_2$) that is formed by the combustion of the siloxane gas portion of the combustible fuel source combines with other elements that are present within the combustion chamber, which may include materials for engine lubrication, to form a hard matrix that accumulates on the combustion surfaces of the internal combustion engine 51, i.e., pistons, rings, cylinder walls, ignition components, valves, and exhaust components. In some examples, during combustion of the siloxane gas, silicon is released and combines with free oxygen or various other elements in the combustion gas.

The silica deposits caused by unimpeded combustion of the siloxanes are off-white in color, and may have a grainy and coarse texture. In one example, the silica deposit is composed of fused silica. Fused silica may contain greater than 95% silicon dioxide ($SiO_2$). In one example, deposits of fused silica are formed in which the silicon dioxide ($SiO_2$) content of the deposit is 99% or greater. The deposits formed from the unimpeded combustion of the siloxane containing gasses within the combustion chamber may also contain calcium, copper, sodium, sulfur and zinc. In some examples, the silica and silicate deposits that are formed by combustion of waste gasses including methane ($CH_4$) and siloxane gasses have a composition that includes 30% to 60% silicon (Si), 20% to 40% oxygen (O), less than 5% sulfur (S) and less than 5% iron (Fe). In another example, the silica deposits that are formed by combustion of waste gasses including methane ($CH_4$) and siloxane gasses have a composition that includes 40% to 50% silicon (Si), 25% to 35% oxygen (O), less than 3% sulfur (S) and less than 2.5% iron (Fe). Calcium may be present in trace amount.

It is estimated that at least 0.1% to 0.5% of the byproducts of unimpeded combustion of siloxane gas from the combustible fuel source that is provided by landfill waste gasses do not exit the internal combustion engine 51 of the power generator 50 via the exhaust stream, and deposit within the combustion and exhaust areas of the engine 51. In one example, in an engine that burns 140 standard cubic feet per minute (SCFM) (at 75 psig) of methane gas containing 1 parts per million by volume (ppmv) siloxane D5 (decamethylcyclopentasiloxane), a total of 0.008 lbs/hour enters the engine. Assuming complete stoichiometric combustion, the 0.008 lbs/hour of siloxane D5 (decamethylcyclopentasiloxane) that enters the engine would be converted to 0.065 lb/hour silica ($SiO_2$) by the following reactions:

$$C_{10}Si_5H_{30}O_5(D5)+20O_2 \rightarrow 5SiO_2+10CO_2+15H_2O \quad (1)$$

$$C_{10}Si_5H_{30}O_5(D5)+15O_2 \rightarrow 5SiO_2+10CO+15H_2O \quad (2)$$

In view of the above example, in one year's time of continuous operation of the power generator 50, the total mass of siloxane D5 entering the internal combustion engine 51 is on the order of 70 lbs. Assuming unimpeded conversion of the siloxane gas to silica ($SiO_2$), the total mass of silica ($SiO_2$) created during combustion in accordance with reactions (1) and (2) is 57 lbs/year. In this example, in which 0.1% to 0.5% of the silica ($SiO_2$) is not expelled from the internal combustion engine 51, and is deposited on surfaces of the combustion chamber and exhaust of the engine, the mass of the deposits of silica ($SiO_2$) that are formed by the combustion of the siloxanes may be as great as 0.06 lb (27.2 g) to 0.29 lb (151.5 g) per year. A fraction of this amount is sufficient to significantly damage the internal components of an internal combustion engine 51.

In some examples, the silica ($SiO_2$) deposits formed by unimpeded combustion of siloxane gas can ultimately build to a surface thickness of several millimeters. As the deposits accumulate, the internal combustion engine's 51 efficiency may fall causing detonation in the combustion chambers. The resultant unburned fuel contaminates the exhaust gas increasing emissions. In view of this inefficient combustion, the internal combustion engine 51 of the power generator 50 may need to be "de-rated", i.e., output reduced, to prevent significant damage to the internal combustion engine 51, and to reduce the emission produced by the internal combustion engine 51. If run unchecked, severe damage can occur to valves, pistons, piston rings, liners, cylinder heads, spark plugs and turbochargers, necessitating premature servicing and costly repairs. For example, reciprocating engines may experience fouling in the combustion chamber, on the valves, valve seats, piston crowns, and cylinder walls. In a further example, the deposits collect under the exhaust valves may result in blowby and burnt valves. This phenomenon reduces compression and engine efficiency. In some instances, the silica ($SiO_2$) deposits caused by combustion of the siloxane gas may be the cause for overhaul of the internal combustion engine 51 of the power generator 50 at 5,000 hours or less of operation.

In the embodiments in which the internal combustion engine 51 is a turbine engine (not shown), the silica ($SiO_2$) deposits can cause severe abrasion of the impeller blades. For example, deposits from siloxane combustion may form in the initial rows of blades and nozzles, in which the combustion temperature of the turbine is the greatest, which may result in erosion of the turbine blades.

In one aspect, the present disclosure reduces the formation of silica ($SiO_2$) deposits, e.g., impedes the formation of silica ($SiO_2$) deposits on the combustion and exhaust surfaces of the internal combustion engine 51. In one embodiment, the present disclosure modifies the properties of the silica ($SiO_2$) deposits by introducing another element, such as a sodium (Na) source, to the combustible fuel source to react with the products that are produced by the combustion of the siloxane gasses. For example, by introducing a sodium (Na) source into the combustible fuel source composed of methane ($CH_4$) and siloxane gas, the silica ($SiO_2$) that is produced by combustion of the siloxane gas is further reacted with sodium (Na) source to form a sodium containing glass or sodium containing silicate. The term "sodium containing glass" denotes a glass composition including sodium (Na), such as soda glass. A glass is an amorphous (non-crystalline) solid material. The term "sodium containing silicate" denotes a composition including sodium (Na), silicon (Si), and oxygen (O), in which the composition is a crystalline solid. Atoms in crystalline solids are positioned in an orderly and repeated pattern, which is contrary to the disordered atomic distribution found in glass compositions.

In some embodiments, in which the atomized sodium (Na) reacts with the siloxanes to provide a sodium containing glass, the sodium containing glass may be composed of about 55 wt. % to about 80 wt. % silica ($SiO_2$) and about 10% to about 25% percent soda ($Na_2O$). The sodium containing glass may further include other elements in amounts less than 1%.

Sodium containing glass has a hardness that is half the hardness value of silica ($SiO_2$) glass, e.g., fused silica glass, that is formed by the unimpeded combustion of siloxane gasses in methane ($CH_4$) based combustible fuel sources, such as those produced by landfill waste gasses. For example, fused silica composed of 99% $SiO_2$ or greater has a Mohs hardness ranging from 5.3 to 6.0, whereas sodium containing glass has a Mohs hardness ranging from 2 to 3. Further, sodium containing glass has a melting temperature that is less than the melting temperature of fused silica deposits, such as deposits composed of 99% $SiO_2$. For example, the melting temperature of sodium containing glass may range from 750° C. to 850° C., whereas the melting temperature of silica ($SiO_2$) deposits, such as fused silica deposits composed of greater than 99% $SiO_2$, may range from 1700° C. to 1800° C. The softening temperature of sodium containing glasses are even lower than the softening temperatures of fused silica deposits, such as fused silica deposits composed of 99% $SiO_2$. For example, the softening temperature of sodium-containing glass may range from 550° C. to 600° C., whereas the melting temperature of silica ($SiO_2$) deposits, such as fused silica deposits composed of greater than 99% $SiO_2$, may be on the order of approximately 1665° C. In some embodiments, sodium containing glass is soluble in water, which allows for deposits composed of sodium containing glass to be removed from the surfaces of the combustion chamber of the internal combustion engine 51 using water based cleaning solutions.

In some embodiments, in which the atomized sodium (Na) reacts with the siloxanes to provide a sodium containing silicate, the sodium containing glass may be composed of orthosilicate ($Na_4SiO_4$), metasilicate ($Na_2SiO_3$), disilicate ($Na_2Si_2O_5$), tetrasilicate ($Na_2Si_4O_9$) or a combination thereof. Similar to sodium-containing glass, sodium containing silicates have a hardness that is half the hardness value of silica ($SiO_2$) glass, e.g., fused silica glass, that is formed by the unimpeded combustion of siloxane gasses in methane ($CH_4$) based combustible fuel sources, such as those produced by landfill waste gasses. In one embodiment, the sodium containing silicate has a Mohs hardness ranging from 2.0 to 3.0. For example, the Mohs hardness of orthosilicate ($Na_4SiO_4$) is about 2.5.

Further, sodium containing silicates have a melting temperature that is less than the melting temperature of fused silica deposits. In one embodiment, the melting temperature of sodium containing silicates may range from 750° C. to 1100° C. For example, the melting temperature of orthosilicate ($Na_4SiO_4$) is about 1088° C. The softening temperature, i.e., glass transition temperature, of sodium containing silicates are also lower than the softening temperatures of fused silica deposits. In one embodiment, the softening temperature of sodium containing silicates may range from 500° C. to 700° C. For example, the softening temperature of orthosilicate ($Na_4SiO_4$) is about 700° C. In some embodiments, sodium containing silicate is soluble in water, which allows for deposits composed of sodium containing silicate to be removed from the surfaces of the combustion chamber of the internal combustion engine 51 using water based cleaning solutions.

The sodium (Na) source may be added to the mixture of the air from the air intake 55 and the combustible fuel source of methane ($CH_4$) and siloxane gas that is provided by the landfill 15 waste gasses. The sodium (Na) source may be produced by atomizing a liquid caustic (NaOH) solution. In one example, the liquid caustic solution is an aqueous solution includes 25 wt. % to 65 wt. % sodium hydroxide (NaOH). In another example, the liquid caustic solution includes 45 wt. % to 55 wt. % sodium hydroxide (NaOH), such as 50 wt. % sodium hydroxide (NaOH). In some examples, the liquid caustic (NaOH) solution may further include less than 40 wt. % sodium oxide ($NaO_2$), less than 1 wt. % sodium carbonate ($Na_2CO_3$), less than 5 wt. % sodium chloride (NaCl), less than 1 wt. % sodium chlorate ($NaClO_3$), less than 0.5 wt. % sodium sulfate ($Na_2SO_4$), and less than 0.1 wt. % iron (Fe).

The amount of atomized sodium (Na) that is required to reduce or substantially eliminate the formation of the silica ($SiO_2$) is dependent upon the amount of siloxane gas that is present in the combustible fuel source. Specifically, in some embodiments, the amount of atomized sodium (Na) is selected to react with all of the silica ($SiO_2$) that is produced by the combustion of the siloxane gas that is present in the combustible fuel source provided by the landfill waste gas. Because the amount of siloxane gas that is produced by the landfill 15 varies with the composition of the decomposing matter within the landfill 15, as well as the temperature and moisture content of the landfill 15, the amount of atomized sodium (Na) may vary. In addition, sulfur, typically in the form of $H_2S$, may be present in the landfill gas in concentrations from 50 ppbv to 200 ppmv. Sufficient sodium must be introduced to allow parasitic formation of sodium sulfate ($Na_2SO_4$) which takes precedence over soda glass or sodium silicate formation.

In one example, the atomized sodium (Na) from liquid caustic (NaOH) solution may range from 0.05% to 0.2% of the fuel mixture being burned within the combustion chamber. In another example, the atomized sodium (Na) from liquid caustic (NaOH) solution may range from 0.1% to 0.15% of the fuel mixture being burned within the combustion chamber.

The liquid caustic (NaOH) solution may be atomized by flowing the liquid through a nozzle. Atomization is conversion of the bulk liquid into a spray or mist, i.e., a collection of drops, often by passing the liquid through a nozzle. In one example, the droplets of the spray of atomized sodium (Na) may have a diameter ranging from 200 microns to 5000 microns. The nozzle may be provided by at least one of air atomizing spray nozzles, hollow cone spray nozzles, flat fan spray nozzles, solid stream nozzles, and full cone spray nozzles.

Figure 2A:
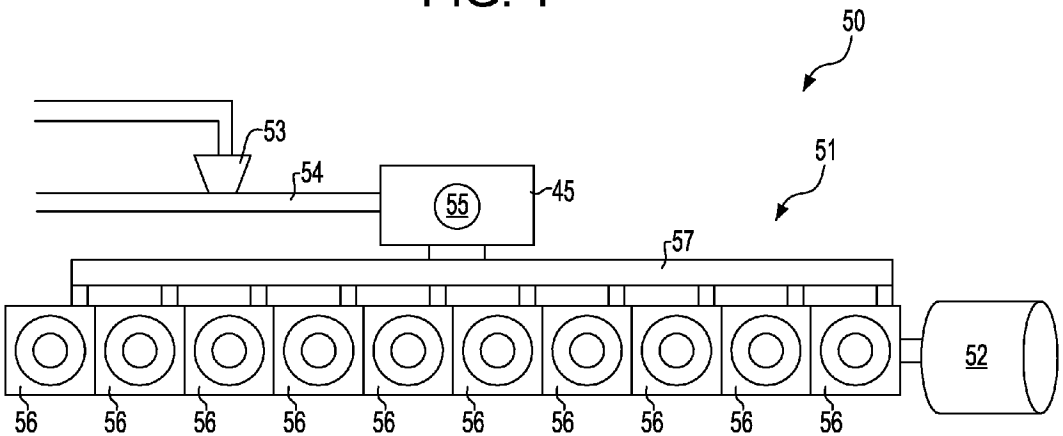
FIG. 2A is a top down schematic view of a power generator, in which an additive for impeding the formation of silica deposits on the combustion and exhaust components of an internal combustion engine of the power generator is introduced to the combustible fuel source that includes methane and siloxane gas prior to the carburetor of the internal combustion engine, in accordance with one embodiment of the present disclosure.
Figure 2B:
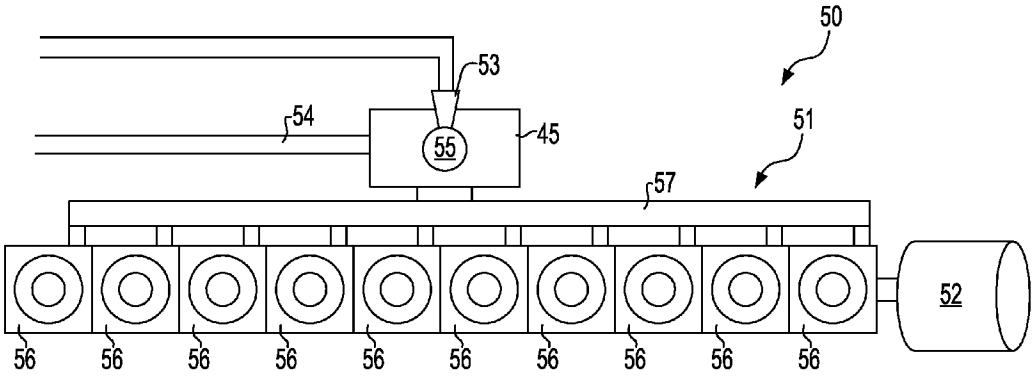
FIG. 2B is a top down schematic view of a power generator, in which an additive for impeding the formation of silica deposits on the combustion and exhaust components of an internal combustion engine of the power generator is introduced to air from the air intake for mixing with the combustible fuel source prior to the carburetor of the internal combustion engine, in accordance with one embodiment of the present disclosure.
Figure 2C:
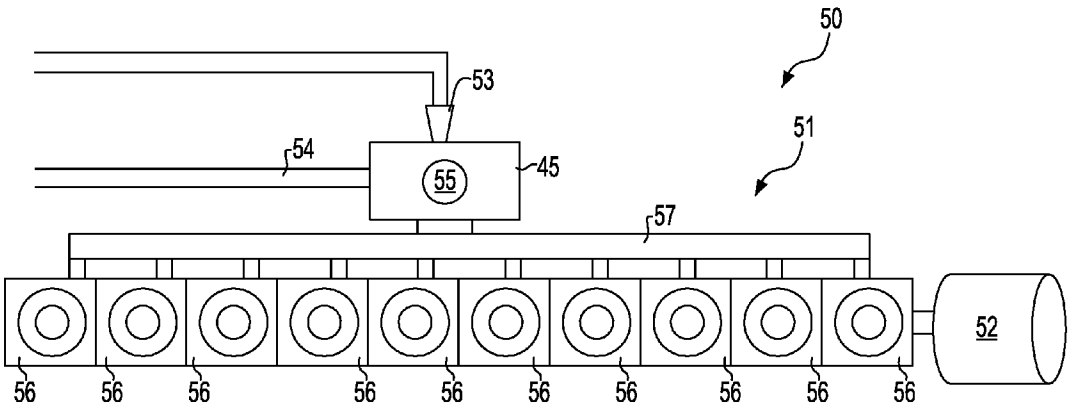
FIG. 2C is a top down schematic view of a power generator, in which an additive for impeding the formation of silica deposits on the combustion and exhaust components of the internal combustion engine of an internal combustion engine of the power generator is introduced to the carburetor for mixing with the air and combustible fuel source, in accordance with one embodiment of the present disclosure.
Figure 2D:
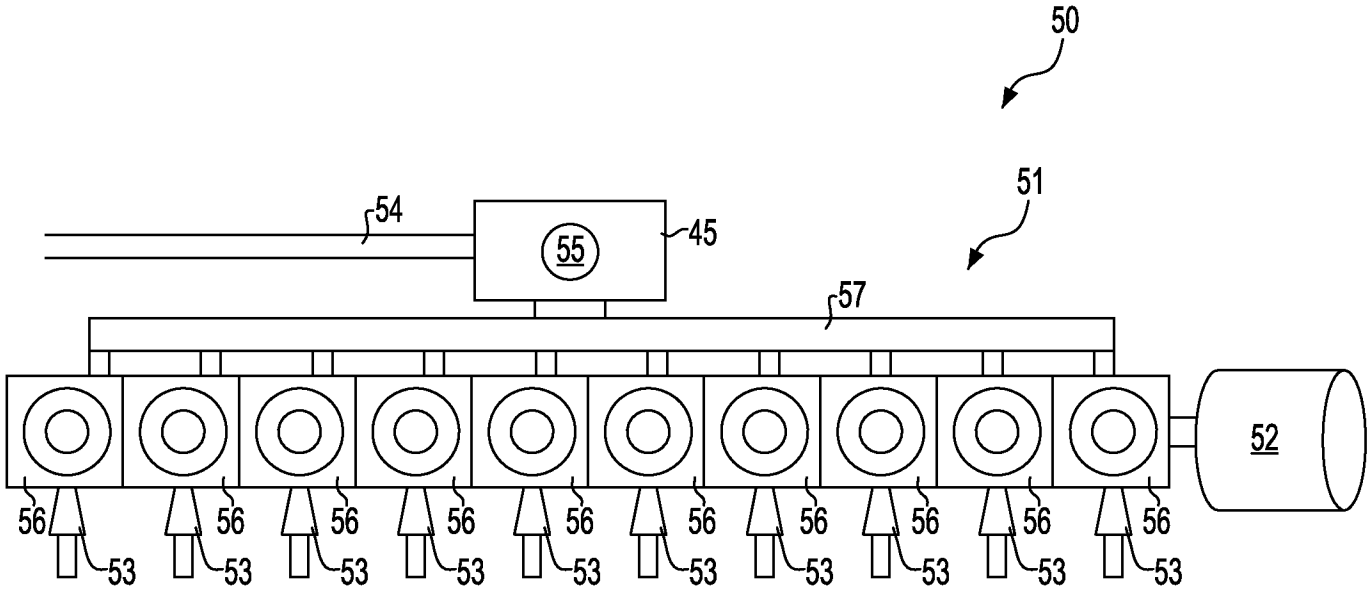
FIG. 2D is a top down schematic view of a power generator, in which an additive for impeding the formation of silica deposits is introduced to the combustion chamber of the internal combustion engine, in accordance with one embodiment of the present disclosure.

Referring to FIG. 2A, in one embodiment, the nozzle 53 may be positioned to introduce atomized sodium hydroxide (NaOH) into the combustible fuel source including the methane ($CH_4$) and siloxane gas prior to entering the carburetor 45. In one embodiment, the nozzle 53 introduces the atomized sodium (Na) into the fuel line that is connected to the carburetor 45. Referring to FIG. 2B, in another embodiment, the nozzle 53 for introducing the atomized sodium hydroxide (NaOH) to the mixture of the air and the combustible fuel source is positioned to inject the atomized sodium hydroxide (NaOH) into the air from the air intake 55. FIG. 2C depicts another embodiment of the present disclosure, in which the atomized sodium hydroxide (NaOH) for impeding the formation of silica deposits on the combustion and exhaust components of the internal combustion engine 51 is introduced to the carburetor 45 for mixing with the air and fuel mixture of the internal combustion engine 51. In yet another embodiment, FIG. 2D is a top down schematic view of a landfill gas power generator, in which an additive for impeding the formation of silica ($SiO_2$) deposits is introduced to the combustion chamber of the internal combustion engine, in accordance with one embodiment of the present disclosure. The caustic solution is typically forced through the nozzle 53 by a pump (not shown) at a sufficient pressure so that the liquid is atomized into a spray of fine droplets, i.e., atomized sodium (Na).

Following the mixing of the atomized sodium (Na), the combustible fuel source, i.e., methane ($CH_4$) and the siloxanes gas, provided by the landfill waste gas, and the air introduced to the internal combustion chamber from the air intake 55, the mixture is introduced to the combustion chambers 56 of the internal combustion engine 51. In the embodiments in which the atomized sodium (Na) is introduced to the combustible fuel source or the air from the air intake 55 before the carburetor 45, as depicted in FIGS. 2A and 2B, or is directly introduced to the carburetor 45 to be intermixed with the air and combustible fuel source mixture, as depicted in FIG. 2C, the mixture of the combustible fuel source including the methane ($CH_4$) and siloxane gasses in combination with the air from the air intake and the atomized sodium (Na) travels from the carburetor 45 into the combustion chambers 56 of the internal combustion engine 51. In some embodiments, a manifold 57 connects the carburetor 45 to the combustion chambers of the internal combustion engine 51, in which an intake runner is in connection with each of the combustion chambers 56 directs the combustible fuel source and atomized sodium (Na) into the combustion chambers 56.

In one example, a typical landfill gas composition is composed of about 54% methane ($CH_4$), 42% carbon dioxide ($CO_2$) and 0.8% oxygen ($O_2$). As utilized as a combustible fuel source the landfill gas may be introduced to the combustion chamber of an engine at a flow rate of about 285 scfm. The methane ($CH_4$) may be introduced to the combustion chamber of the engine at a flow rate of about 153.95 scfm. The carbon dioxide ($CO_2$) may be introduced to the combustion chamber of the engine at a flow rate of about 119.70 scfm. The oxygen ($O_2$) may be introduced to the combustion chamber of the engine at a flow rate of about 2.1186 scfm. The combustible fuel source may also include hydrogen sulfide ($H_2S$), in which the hydrogen sulfide enters the combustion chamber of the engine at a flow rate of about 0.0166 scfm. In this example, the combustible fuel source introduces siloxanes to the combustion chamber of the engine at a flow rate of about 0.0131 scfm. To counter the effects of the siloxanes, the atomized sodium (Na), e.g., atomized sodium hydroxide (NaOH), may be introduced to the combustion chamber of the engine with a vapor injection rate of about 0.02 scfm of a 50% solution.

In another example, in which the internal combustion chamber has a displacement ranging from 200 L to 400 L, the combustible gas is composed of 20% to 60% methane and 0.0002% to 0.006% siloxane, and the combustible gas enters the combustion chamber of the generator at a flow rate ranging from 200 scfm to 400 scfm. To counter the effects of the siloxanes, the sodium containing molecule is introduced to the combustion chamber at a flow rate ranging from 0.08 scfm to 5 scfm.

Once the mixture of the atomized sodium (Na), e.g., atomized sodium hydroxide (NaOH), combustible fuel source, i.e., methane and siloxane gas, and air from the air intake 55 enters the combustion chamber 56 it is ignited. Typically, the ignition source is provided by a spark plug. Igniting the combustible fuel source including the atomized sodium (Na) in the combustion chamber 56 of the internal combustion engine 51 causes the silicon containing product, i.e., silica ($SiO_2$), that is the product of siloxane combustion to react with the atomized sodium (Na) to produce a sodium containing glass or sodium containing silicate.

By reacting the atomized sodium (Na), e.g., sodium hydroxide (NaOH), with silicon containing product formed from the combustion of the siloxane gas, the formation of silica ($SiO_2$) deposits on the surfaces of the combustion chamber 56 and the exhaust components of the internal combustion engine 51 is reduced or substantially eliminated. For example, the atomized sodium hydroxide (NaOH) reduces or substantially eliminates the formation of silica ($SiO_2$) deposits on the valves, pistons, piston rings, liners, cylinder heads, spark plugs and turbochargers of the internal combustion engine 51. Further, the deposits that may be formed from the reaction of the atomized sodium (Na) with the products of the combusted siloxane gas will have a hardness, melting temperature, and softening temperature lower than silica ($SiO_2$) deposits. Therefore, the abrasiveness of the softer sodium containing glass and sodium containing silicate deposits that are formed from reaction with the atomized sodium (Na), such as atomized sodium hydroxide (NaOH), and the products of the combusted siloxane gas will not substantially abrade the combustion and exhaust surfaces of the internal combustion engine 51, when compared to the abrasion of the harder silica ($SiO_2$) deposits, such as those formed by siloxane combustion in the absence of atomized sodium (Na). The softness of the sodium containing glass and/or the sodium containing silicate is further enhanced by the low melting temperature and low softening temperature, in comparison to silica ($SiO_2$) deposits that are formed in the absence of atomized sodium (Na).

In another embodiment, the formation of silica ($SiO_2$) deposits may be reduced or substantially eliminated by a magnesium source that is mixed with the combustible fuel source. For example, by introducing magnesium (Mg) source, such as magnesium acetate ($Mg(CH_3COO)_2$), into the combustible fuel source composed of methane ($CH_4$) and siloxane gas, the silica ($SiO_2$) that is produced by combustion of the siloxane gas is further reacted with the magnesium (Mg) source to form a magnesium containing silicate, such as talc ($Mg_3Si_4O_{10}(OH)_2$). The term "magnesium containing silicate" denotes a composition including magnesium (Mg) and silicon (Si). In one example, the magnesium containing silicate formed in accordance with the present disclosure is talc ($Mg_3Si_4O_{10}(OH)_2$).

Talc ($Mg_3Si_4O_{10}(OH)_2$) has a hardness that is substantially lower than the hardness value of silica ($SiO_2$) glass, e.g., fused silica glass, that is formed by the unimpeded combustion of siloxane gasses in methane ($CH_4$) based combustible fuel sources, such as those produced by landfill waste gasses. For example, fused silica composed of 99% $SiO_2$ or greater has a Mohs hardness ranging from 5.3 to 6.0, whereas a magnesium containing silicate, such as talc ($Mg_3Si_4O_{10}(OH)_2$), has a Mohs hardness of less than 1.0.

The magnesium (Mg) source may be added to the mixture of the air from the air intake 55 and the combustible fuel source of methane ($CH_4$) and siloxane gas that is provided by the landfill 15 waste gasses. The magnesium (Mg) source may be produced by atomizing magnesium acetate (Mg $(CH_3COO)_2$). In one example, the magnesium acetate (Mg $(CH_3COO)_2$) is provided by an aqueous solution that includes 20% to 50% magnesium acetate ($Mg(CH_3COO)_2$), such as 35% magnesium acetate.

The amount of atomized magnesium (Mg) that is required to reduce or substantially eliminate the formation of the silica ($SiO_2$) is dependent upon the amount of siloxane gas that is present in the combustible fuel source. Specifically, in some embodiments, the amount of atomized magnesium (Mg) is selected to react with all of the silica ($SiO_2$) that is produced by the combustion of the siloxane gas that is present in the combustible fuel source provided by the landfill gas. Because the amount of siloxane gas that is produced by the landfill 15 varies with the composition of the decomposing matter within the landfill 15, as well as the temperature and moisture content of the landfill 15, the amount of atomized magnesium (Mg) may vary.

In one example, the atomized magnesium (Mg) from the magnesium acetate solution ($Mg(CH_3COO)_2$) may range from 0.05% to 0.2% of the fuel mixture being burned within the combustion chamber. In another example, the atomized magnesium (Mg) from the magnesium acetate solution (Mg $(CH_3COO)_2$) may range from 0.1% to 0.15% of the fuel mixture being burned within the combustion chamber.

The magnesium acetate ($Mg(CH_3COO)_2$) solution may be atomized into a magnesium (Mg) source using methods that are similar to the methods described above for atomizing the liquid caustic (NaOH) solution into a sodium source (Na), as described above. Further, the method by which the atomized magnesium (Mg) is introduced to the internal combustion engine 51 is similar to the method by which the atomized sodium (Na), such as atomized sodium hydroxide (NaOH), is introduced to the internal combustion engine 51, as described above with reference to FIGS. 2A-2C.

Once the mixture of the atomized magnesium (Mg) source, combustible fuel source, i.e., methane and siloxane gas, and air from the air intake 55 enters the combustion chamber 56 it is ignited. Typically, the ignition source is provided by a spark plug. Igniting the combustible gas including the atomized magnesium (Mg) source in the combustion chamber 56 of the internal combustion engine 51 causes the silicon containing product, i.e., silica ($SiO_2$), that is the product of siloxane combustion to react with the atomized magnesium (Mg) to produce a magnesium containing silicate, e.g., talc ($Mg_3Si_4O_{10}(OH)_2$).

In one example, in which the generator has a displacement ranging from 200 L to 400 L, and the combustible gas comprises 20% to 60% methane and 0.0002% to 0.006% siloxane, the combustible gas enters the combustion chamber of the generator at a flow rate ranging from 200 scfm to 400 scfm. To counter the effects of the siloxanes, the magnesium containing molecule is introduced to the combustion chamber at a flow rate ranging from 0.08 scfm to 5 scfm.

In one example, in which the atomized magnesium (Mg) source is magnesium acetate ($Mg(CH_3COO)_2$), the atomized magnesium acetate ($Mg(CH_3COO)_2$ reacts with the silica ($SiO_2$) product that is produced by the combustion of the siloxane gas in the presence of carbon dioxide ($CO_2$) to form a magnesium containing silicate, e.g., talc ($Mg_3Si_4O_{10}(OH)_2$), via a reaction as follows:

$$4Si+3Mg(CH_3COO)_2+16O_2 \rightarrow Mg_3Si_4O_{10}(OH)_2+8H_2O+12CO_2 \quad (3)$$

It is noted that the magnesium containing silicate, i.e., talc ($Mg_3Si_4O_{10}(OH)_2$), which is the product of reaction (3) is only one example of a magnesium containing silicate that may be formed in accordance with the present disclosure. Other magnesium containing silicate compositions are within the scope of the present disclosure that may be formed by the reaction of atomized magnesium (Mg) source and the products of siloxane gas combustion. For example, suitable compositions for magnesium containing silicate further include forsterite ($Mg_2SiO_4$), enstatite ($MgSiO_3$), chrysotile ($Mg_3Si_2O_5(OH)_4$), lizardite ($Mg_3Si_2O_5(OH)_4$), spadadite ($MgSiO_2(OH)_2.H_2O$), sepiolite ($Mg_4Si_6O_{15}(OH)_2.6H_2O$), laughlinite ($Na_2Mg_3Si_6O_{16}(OH)_2.8H_2O$) and combinations thereof.

By reacting the atomized magnesium (Mg) source with the silicon containing product formed from the combustion of the siloxane gas, the formation of silica ($SiO_2$) deposits on the surfaces of the combustion chamber 56 and the exhaust components of the internal combustion engine 51 is reduced or substantially eliminated. In some embodiments, complexes may be forming between the atomized magnesium (Mg) source and the siloxane gas combustion products that prevent the silica ($SiO_2$) from depositing on the components of the internal combustion engine 51. Specifically, the complexes and/or particulates remain entrained in the combustion and exhaust gas flow so that the silica ($SiO_2$) and magnesium contained silicates flow through the internal combustion engine 51 exiting through the exhaust. The atomized magnesium (Mg) reduces or substantially eliminates the formation of silica ($SiO_2$) deposits on the valves, pistons, piston rings, liners, cylinder heads, spark plugs and turbochargers of the internal combustion engine 51. Further, the magnesium containing silicate deposits that may be formed from the reaction of the atomized magnesium (Mg) with the products of the combusted siloxane gas will have a hardness that is less than the silica ($SiO_2$) deposits. Therefore, the abrasiveness of the softer magnesium containing silicate deposits that are formed from reaction with atomized magnesium (Mg) and the products of the combusted siloxane gas will not substantially abrade the combustion and exhaust surfaces of the internal combustion engine 51, when compared to the abrasion of the harder silica ($SiO_2$) deposits, such as those formed by siloxane combustion in the absence of atomized magnesium (Mg) species.

While the structures and methods of the present disclosure have been described with respect to the preferred embodiments thereof, it will be understood by those skilled in the art that the foregoing and other changes in forms of details may be made without departing from the spirit and scope of the present disclosure. It is therefore intended that the present disclosure not be limited to the exact forms and details described and illustrated, but fall within the scope of the appended claims.

What is claimed:

1. A waste gas combustion method comprising:

providing a combustible fuel source comprising at least methane and siloxane gas;

mixing a sodium source with the combustible fuel source; and igniting the combustible fuel source including the sodium source in an internal combustion engine, wherein a silicon containing product of combustion of the siloxane gas and the sodium source react to produce a sodium containing glass or sodium containing silicate within the internal combustion engine.

2. The method of claim 1, wherein the sodium containing silicate comprises orthosilicate (($Na_4SiO_4$), metasilicate ($Na_2SiO_3$), disilicate ($Na_2Si_2O_5$), tetrasilicate ($Na_2Si_4O_9$), or a combination thereof.

3. The method of claim 1, wherein the formation of sodium containing glass substantially eliminates silica deposit formation with a combustion chamber of the internal combustion engine, substantially eliminates silica deposit formation on ignition components of the internal combustion engine, substantially eliminates silica deposit formation on exhaust components of the internal combustion engine, or a combination thereof.

4. The method of claim 1, wherein the combustible fuel source is a landfill waste gas.

5. The method of claim 1, wherein the methane that is present in the combustible fuel source ranges from 30% to 60%, and the siloxane gas that is present in the combustible fuel source ranges from 0.0002% to 0.006%.

6. The method of claim 1, wherein the siloxane gas is selected from the group consisting of hexamethylcyclotrisiloxane ($C_{12}H_{18}O_3Si_3$), octamethylcyclotetrasiloxane ($C_8H_{24}O_4Si_4$), decamethylcyclopentasiloxane ($C_{10}H_{30}O_5Si_5$), dodecamethylcyclohexasiloxane ($C_{12}H_{36}O_6Si_6$), hexamethylsiloxane, hexamethyldisiloxane ($C_6H_{18}Si_2O$), octomethyltrisiloxane ($C_8H_{24}Si_3O_2$), decamethyltetrasiloxane ($C_{10}H_{30}Si_4O_3$), and dodecamethylpentasiloxane ($C_{12}H_{36}Si_5O_4$).

7. The method of claim 1, wherein the combustible fuel source further comprises at least one of carbon dioxide ($CO_2$), oxygen ($O_2$), $H_2S$, $H_2O$, $N_2$, CO and combinations thereof.

8. The method of claim 1, wherein the internal combustion engine is in connection with a generator for converting landfill waste gas into electricity.

9. The method of claim 8, wherein the sodium source is provided by atomizing a liquid solution of sodium hydroxide (NaOH).

10. The method of claim 9, wherein the mixing of the sodium source with the combustible fuel source further comprises intake air.

11. The method of claim 10, wherein the atomizing is provided by a nozzle and a fuel pump, wherein the nozzle introduces the sodium source to the combustible fuel source prior to a carburetor, the nozzle introduces the sodium source to the air being introduced to the internal combustion engine thorough the air intake, the nozzle introduces the sodium source directly to the carburetor, the nozzle is introducing the sodium source directly to the combustion chamber of the internal combustion chamber, or a combination thereof.

12. The method of claim 11, wherein the internal combustion chamber has a displacement ranging from 200 L to 400 L, the combustible gas comprises 20% to 60% methane and 0.0002% to 0.006% siloxane, the combustible gas enters the combustion chamber of the generator at a flow rate ranging from 200 scfm to 400 scfm, and the sodium containing molecule is introduced to the combustion chamber at a flow rate ranging from 0.08 scfm to 5.0 scfm.

* * * * *